United States Patent [19]

Brooker

[11] Patent Number: 4,778,188

[45] Date of Patent: Oct. 18, 1988

[54] WALL CONSTRUCTING TILE GAME

[76] Inventor: Paul A. M. Brooker, 34 Ranui Terrace, Wellington, New Zealand

[21] Appl. No.: 904,201

[22] Filed: Sep. 8, 1986

[30] Foreign Application Priority Data

Sep. 6, 1985 [NL] Netherlands ..... 213386
May 5, 1986 [NL] Netherlands ..... 213386

[51] Int. Cl.[4] ..... A63F 9/20
[52] U.S. Cl. ..... 273/293; 273/306
[58] Field of Search ..... 273/292, 293, 295, 306

[56] References Cited

U.S. PATENT DOCUMENTS

| | | | |
|---|---|---|---|
| 793,455 | 6/1905 | Mandelbaum | 273/292 |
| 2,782,039 | 2/1957 | Martin | 273/292 |
| 3,827,695 | 8/1974 | Hess | 273/292 |
| 4,630,831 | 12/1986 | Stadden | 273/292 |

*Primary Examiner*—Anton O. Oechsle
*Attorney, Agent, or Firm*—Holman & Stern

[57] ABSTRACT

A wall constructing tile game for a number of players utilizes a set of tiles having a shape suitable to enable them to be stably placed on a substantially flat playing support surface, to enable at least one to be stably placed on top of another tile, and to enable the player to place one edge of one tile against one edge of another tile thereby establishing a directional relationship between the tiles, the set of tiles being separated into a plurality of identifiable sub-categories of tiles. The rules of the game require players to construct a wall using tiles, each player randomly selecting a pre-determined number of tiles from the sub-category of "tower tiles" and a predetermined number from another sub-category of "wall tiles" of a number of suits, each suit having a sequence. The players take turns playing the tiles to construct a wall by (I) playing a single wall tile or several wall tiles adjacent each other of the same suit in a sequential manner as a "straight" or "run" or playing wall tiles one upon another of differing suits and of the same position and (II) playing a tower tile to complete a turn and provide a location from which to start a next turn with the suit of the tower tile matching the suit of the adjacent wall tile, the aim of the game being for a player to be the first to play his tiles.

14 Claims, 6 Drawing Sheets

WALL CONSTRUCTING TILE GAME

BACKGROUND OF THE INVENTION

Field of the Invention

The present invention relates to games and more particularly to games played by two or more players utilizing playing pieces of a uniform size having varying indicia from one piece to the next.

BRIEF SUMMARY OF THE INVENTION

There is an ongoing desire of people to play games either as a serious pursuit or as a leisure activity. It is an object of this invention to provide an easily transportable game which will supply the player or players with a challenge that requires some skill of thought and a degree of competitiveness enabling a winning player to be decided.

Accordingly, the present invention consists in apparatus for a game for a number of players comprising a set of objects (hereinafter referred to as "tiles"), the selected shape of the tiles being suitable to enable them to be stably placed on a substantially flat playing support surface and being suitable to enable at least one of the tiles to be stably placed on top of another, the edges of the tiles being suitable to enable the player to place one edge of one tile against one edge of another tile thereby establishing a directional relationship between the tiles, the set of tiles being separated into more than one sub-category of tiles, each sub-category comprising tiles which are identifiable as a member of a given sub-category. The rules of the game require the players to construct a wall using the tiles, each player randomly selecting a pre-determined number of tiles from one of the sub-categories comprising tiles required to complete each turn (hereinafter referred to as "tower tiles") and a predetermined number of tiles from another of the sub-categories comprising unique tiles of a number of suits, each suit comprising a sequence (the sub-category hereinafter referred to as "wall tiles"), the players taking turns to play the tiles so constructing the wall from the tiles in a manner as hereinafter described, each turn comprising (I) the playing of a single wall tile or the playing of several wall tiles one adjacent the next of the same of the suits in a sequential manner (hereinafter referred to as a "straight" or "run") or the playing of wall tiles one upon another of differing suits and of the same position (hereinafter referred to as a "double" or "pile"), and (II) the playing of a tower tile to complete a turn and provide a location from which to start the next turn with the proviso that the suit of the tower tile matches the suit of the adjacent wall tile (hereinafter referred to as "matching"), the aim of the game being for a player to play all the tiles in his hand (excluding left over tower tiles) before the opposing player or players and in the event that no player is able to play all the tiles in his hand (excluding left over tower tiles) the winner is determined by reference to the number and type of tiles remaining of each player's hand.

Preferably there is included a further sub-category of tiles comprising unique tiles which are required to cross over the wall in a direction indicated by such a unique tile (hereinafter referred to as "wind tiles"), the playing of a wind tile to cross the wall (hereinafter referred to as "winding" or "wind forting") being achieved by placing any such wind tile in the constructed wall.

Preferably there is included a further sub-category of tile comprising at least one tile playable as a substitute for any other sub-category of tile only with the exception of wind tiles (hereinafter referred to as "soldier tiles") the playing of a soldier tile in place of any wall or tower tile being permitted.

Preferably means is provided to define a location from which the first turn is to be taken in a predetermined direction on said playing surface.

Preferably the means to provide the location comprises a "start tile".

Preferably the rules require a player to have a predetermined number of wall tiles, the identity of which is known to him (hereinafter referred to as the "open hand") and an additional number of tiles, the identity of which is unknown to that particular player for a part of the game (hereinafter referred to as the "concealed hand"), the rules of the game permitting the player to play firstly the tiles of the open hand and thereafter when the entire open hand has been played the tiles of the concealed hand.

Preferably said wall tiles consist of 32 members.

Preferably said tower tiles consist of 16 members.

Preferably said wind tiles consists of four members.

Preferably said soldier tiles consist of four members.

BRIEF DESCRIPTION OF THE DRAWINGS

The preferred form of the present invention will now be described in detail with reference to the accompanying drawings wherein.

DETAILED DESCRIPTION

Figure 25A:
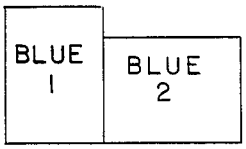
FIGS. 25*a* and 25*b* are top plan views of rectangular wall tiles added together in ways that are not permissible.
Figure 25B:
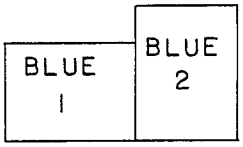
Figure 20A:
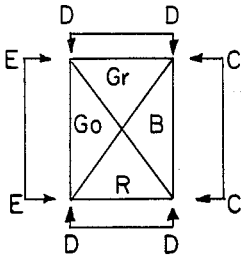
FIG. 20*a* is a top plan view of one of the two types of rectangular tower tile.
Figure 20B:
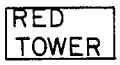
FIGS. 20*b* to 20*e* are side elevation views of the tile taken from views B—B to E—E in FIG. 20*a,* respectively.
Figure 20C:
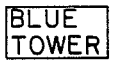
Figure 20D:
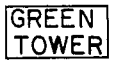
Figure 20E:
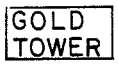
Figure 21A:
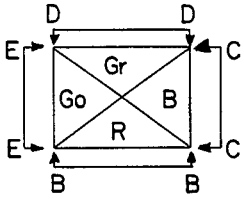
FIG. 21*a* shows a plan view of the other type of rectangular tower tile.
Figure 21B:
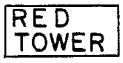
FIGS. 21*b* to 21*e* are side elevation views of the tile taken from views B—B to E—E in FIG. 21*a,* respectively.
Figure 21C:
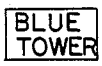
Figure 21D:
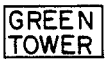
Figure 21E:
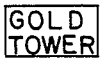

Preferably the game is played with square shaped tiles but it is to be appreciated that the game can be played with tiles of other shapes. A second preferred tile shape is rectangular. The preferred modifications to the game if rectangular tiles are used are described with reference to FIGS. 20*a* and 25*b* later.

Preferably the game is played by two players although it is to be appreciated that the game could be played by three or four players and preferably (for three or four players) using a double set of tiles.

Preferably the tiles include a first sub-category consisting of one tile which is distinct from all other tiles known as the "start tile" 10 (FIG. 1) which has indicia or means to establish a direction datum on its face displaying the directions of North, South, East and West and having each of the four edges of its indicia covered face represent one of these directions.

Figure 1A:
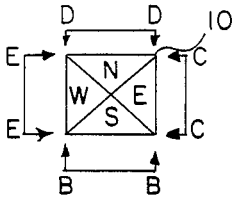
FIG. 1*a* is a top plan view of the start tile.
Figure 1B:
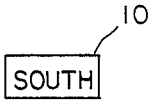
FIGS. 1*b* to 1*e* are side elevation views of the tile of FIG. 1*a* taken from the views B—B, C—C, D—D and E—E respectively.
Figure 1C:
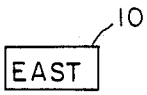
Figure 1D:
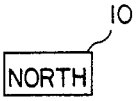
Figure 1E:
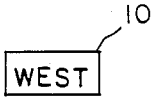
Figure 2A:
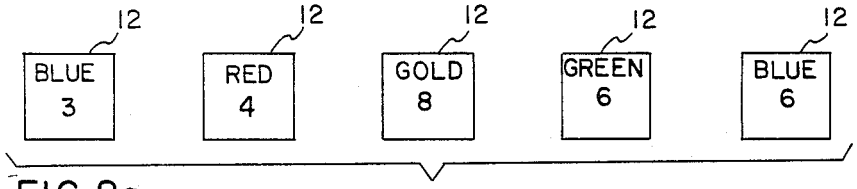
FIGS. 2*a* and 2*b* show top plan and side elevation views, respectively, of five examples of wall tiles.
Figure 2B:
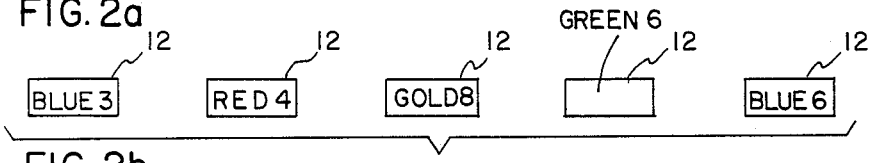
Figure 3A:
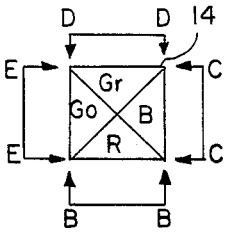
FIG. 3*a* is a top plan view of a tower tile.
Figure 3B:
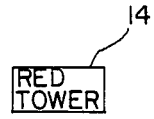
FIGS. 3*b* to 3*e* are side views of the tile of FIG. 3*a* taken from the views B—B, C—C, D—D, and E—E respectively.
Figure 3C:
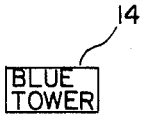
Figure 3D:
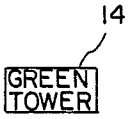
Figure 3E:
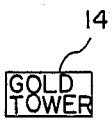

Preferably the tiles include a second subcategory that is distinct from the first hereafter known as "wall tiles" 12 (FIG. 2) whose members are divided into four suits preferably defined by four different colors on the basis of one color per suit. For example, red, blue, green and gold, each represent a suit, (FIG. 2). Each of these said suits has the same number of members and the members of each suit are consecutively numbered to form a numerical sequence identical with that of the other suits. Each wall tile has indicia on its face showing the color of the suit of which it is a member and shown preferably by a numeral, or alternatively by another means, e.g. a series of dots, the position which it occupies in the numerical sequence of the suit to which it belongs. Preferably the edges of the wall tiles are blank. Hence the color and numeral indications in the drawings on edges are for explanational purposes only. Of course, the wall tiles at least must have all indicia on the one face if their suit and number have to be concealed (a) from both players when randomly selecting their concealed and open hands (b) from both players when constituting a "concealed" hand, and (c) from the opponent, when they form part of the "open" hand. Preferably there are 32 wall tiles with 8 wall tiles in each suit.

Preferably the tiles include a third sub-category of tiles that are distinct from the first and second and hereinafter known as "tower tiles" 14 (FIG. 3), which has a plurality of identical members having indicia on their faces showing the particular color represented by each of the four edges of the tiles that are visible when it is laid indicia face upwards on a plane surface, and these four colors are identical to the four colors used to define the four suits of wall tiles. Hence the colour indications in the drawings on edges are for explanational purposes only. Preferably there are sixteen tower tiles.

Figure 4A:
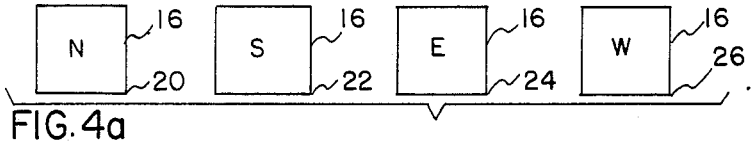
FIGS. 4*a* and 4*b* show top plan and side elevational views, respectively, of the four wind tiles.
Figure 4B:
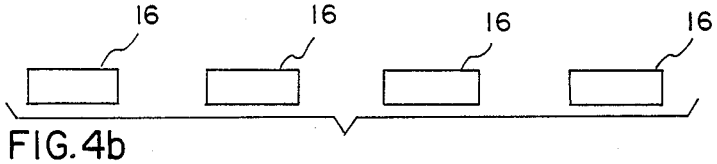

Preferably the said tiles include a fourth sub-category of tiles that is distinct from the first, second and third sub-categories and is hereinafter known as "wind tiles" 16 (FIG. 4) which has indicia showing the direction of the particular wind each represents and these directions are North, South, East and West. The wind tiles 16 are the North wind tile 20, the South wind tile 22, the East wind tile 24 and the West wind tile 26. Preferably the edges of the wind tiles are blank. Preferably there are only four wind tiles.

Figure 5A:
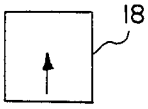
FIGS. 5*a* and 5*b* show top plan and side elevational views, respectively, of a soldier tile.
Figure 5B:
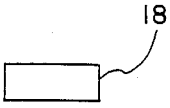

Preferably the said tiles include a fifth sub-category of tiles that is distinct from the first, second, third and fourth sub-categories and is hereinafter known as "soldier tiles" 18 (FIG. 5) which has indicia to the effect that they belong to the sub-category known as "soldier tiles". Preferably there are four soldier tiles.

The object of the game is for a player to add as many tiles as the player can to a continuous and common wall formed by various members of the said sub-categories of tiles.

The preferred playing area comprises a substantially smooth support surface of a size chosen to be convenient by the players of the game. The edges of the playing surface define the limits of movement of the wall in any direction. A turn cannot be made it if reaches the edge of the playing surface before being completed.

Preferably the players select the tiles using the following procedure which is used when two players are selecting their tiles. However it is to be appreciated that the procedure can be easily adapted to enable up to four players to select their playing tiles.

1. One player hides the North wind 20 and the South wind 22, one in each hand and the opponent points to one of those hands to determine which player shall be North and which South, sitting at opposite sides of the playing surface.

2. North takes the North wind 20 and East wind 24 and South takes the South wind 22 and West wind 26.

3. Each player takes any two of the four soldier tiles 18 and anny eight of the sixteen tower tiles 14 which are placed indicia face up at the players extreme right.

4. Except for the start tile 10, the remaining tiles (the wall tiles 12) are placed indicia face downwards in the center of the playing surface and moved around to ensure they are well shuffled.

5. Each player then selects randomly any eight wall tiles from the middle, leaving them unseen by himself as well as his opponent and face down at their extreme left. They are the "concealed" hand which will be used later in the game.

6. Each player selects randomly a further eight wall tiles, the "open" hand, from the center and lines them up on an edge with their indicia faces towards the player so that their symbols may be seen by the player, but not by the opponent. If, during play, the wall turns into the tiles of the hand of one of the players, the tiles in the hand should be shifted to one side to enable play to continue.

7. The wall begins by the player holding the North wind tile positioning the start tile 10 near the center of the playing surface with its indicia face upwards and the North edge pointing towards him and then the same player laying a wall tile or tiles 12, with indicia face upwards, adjacent any one edge of the start tile so that one of the edges of the wall tile 28 touches an edge of the start tile. Note, that preferably no further wall tiles or other type of tile may be added to any other edge of the start tile after the first wall tile or tiles have been added to it, nor preferably may it be linked to other tiles during a winding or forting turn. Optionally, the turn can be completed by the playing of a tower tile 14 with indicia face upwards alongside the immediately previously played wall tile 28 so that the edges of the two tiles touch and the tower tile is laid in the same direction as the said wall tile and the edge of the tower tile touching the edge of the wall tile as shown by indicia on the face of the tower tile is the same color as that of the wall tile (FIG. 6), or a further wall tile can be played by placing it 30, with indicia face upwards, alongside the previously played wall tile 28 so that the edges of the two wall tiles touch and the wall continues in the same direction as the direction in which the previously played wall tile 28 was played. However, the second wall tile 30 must be of the same suit as the previously played wall tile and must bear the numeral immediately following that of the numeral borne by the previously played wall tile 28 in the numerical sequence of that suit. In other words, the numeral of the second played wall tile 30 must be one number higher than the numeral of the first played wall tile 28 (FIG. 7*a*). It should be noted that a straight can have more than two tiles in numerical sequence and in theory could contain a whole suit.

Figure 7A:
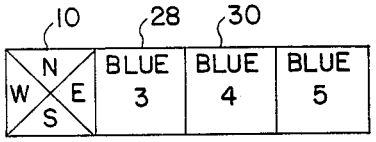
FIG. 7*a* shows a straight played from a start tile.
Figure 7B:
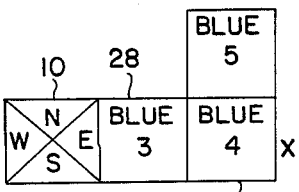
FIGS. 7*b* and 7*c* show two turns which are not permissible.
Figure 7C:
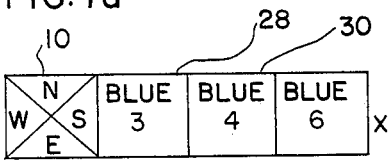

The playing in succession of more than one wall tile of the same suit in a numerical sequence will be hereinafter known as a "run" or a "straight" (FIG. 7*a*) and the method of playing may occur at any stage of the construction of the wall, but with the restriction as mentioned hereinafter. In a run or a straight the tiles must be added edge to edge in a straight line with no change of direction. (FIGS. 7*b* and 7*c* show moves which are not permitted).

Figure 8:
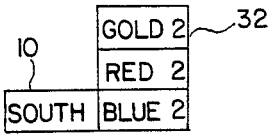
FIG. 8 is a side elevational view of a pile played from a start tile.

An alternative method of playing wall tiles occurs when two, three or four tiles bearing the same numeral but, necessarily of different suits are placed one on top of the other to form what is hereinafter known as a "pile" or "double" (FIG. 8) and this pile 32 is played as if it were a single wall tile with the top or uppermost tile of the pile representing the suit and numeral of the pile as a whole.

The tiles in a pile 32 can be stacked in any order within the pile and a pile can be included in a run of tiles as long as the uppermost tile of the pile has the required color as well as numeral for that particular run.

Figure 6:
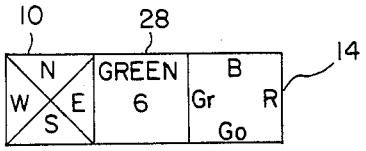
FIG. 6 shows a top plan view of a standard one wall tile addition starting at the start tile; and completed with a tower tile.
Figure 9A:
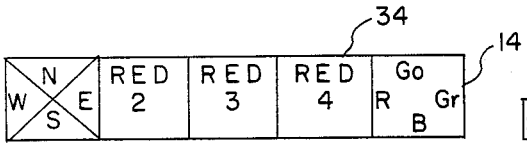
FIGS. 9*a* and 9*b* show top plan and side elevational views, respectively, of a straight made with doubles completed with the tower tile.
Figure 9B:
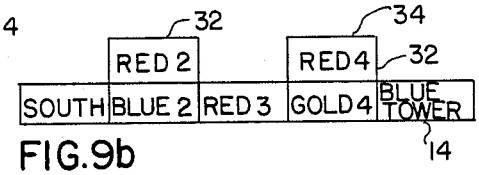

After a player has played a wall tile, or a run, or a pile of wall tiles, a tower tile 14 must be played to complete the turn (FIGS. 6 and 9).

The tower tile is played by laying it, with indicia face upwards, alongside the immediately previously played wall tile 34 so that the edges of the two tiles touch and the tower tile is laid in the same direction as the said wall tile and the edge of the tower tile touching the edge of the wall tile as shown by indicia on the face of the tower tile is the same color as that of the wall tile (FIG. 9*a*).

Figure 10B:
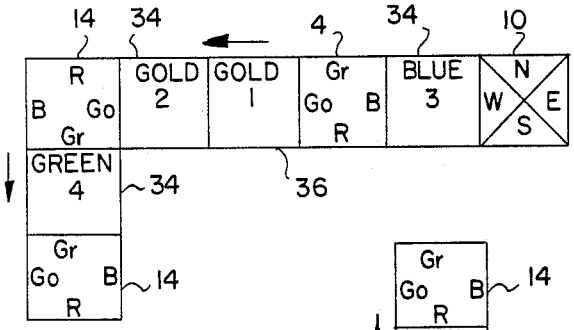
FIGS. 10*a* and 10*b* show the wall changing direction in a rightward and leftward direction respectively at the tower tile.
Figure 10A:
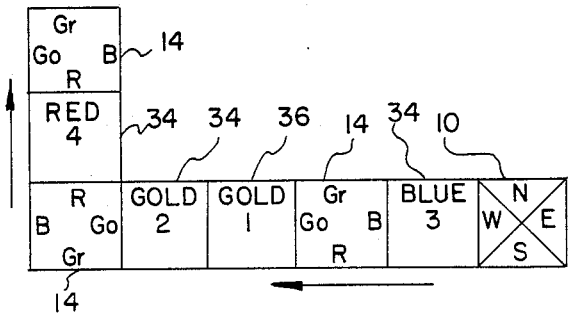

The same need to match the color of the wall tile 36 with the color of the edge of the tower tile 14 it touches occurs when a wall tile is added to a tower (FIGS. 10*a* and 10*b*).

This matching of the color of a wall tile with the color of the touching side of the tower added to it, or to which it is added, is a key element of the game and is hereinafter known as "matching".

The tower tile must be laid in the same direction as the wall tile to which it is added, but the tower tile can be used to change the direction of the wall. For in the further construction of the wall the wall tile or tiles can be added to any of the still available sides of the immediately previously played tower as long as the color of the wall tile and the indicated color of the side of the tower tile to which it is added are the same. Thus, as long as the player adds the wall tile of the required color, a player can, when adding to a tower, choose either to continue the direction of the wall or to make a right angle turn to the right (FIG. 10*a*), or to the left (FIG. 10*b*) of that direction.

Figure 11:
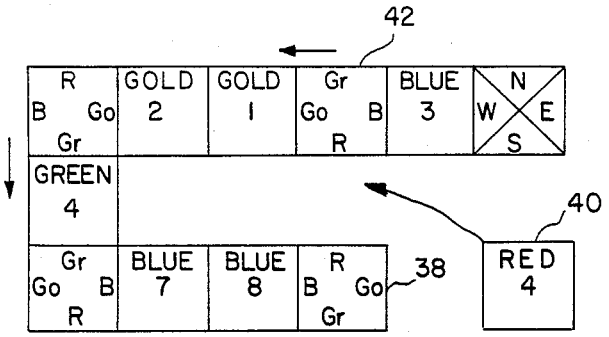
FIG. 11 shows the forting turn.

The only occasion when a player is permitted to make two changes of the wall's direction in one turn is when a player is making a right angled addition to the wall, either in a leftwards or rightwards direction, and finds on playing the tower tile 38 (FIG. 11) to complete the addition that if the player made a further right angled addition to the first addition, the second right angled addition being of the same leftwards or rightwards direction as the first, the player will be able to connect up the wall tile 40, or tiles, of this addition with a tower tile 42 in the existing wall to form a square or rectangle with a tower in each corner. The player may make this second addition if in doing so the wall tile or tiles (as in a pile or run) played 40 match both the edge of the tower tile 38 to which it or they are added and the side of the tower tile 42 to which it or they are connected. The tower tile 42 in the existing wall performs the usual role of a tower tile of completing a turn. This distinctive method that allows two changes of the wall's direction in the one turn and allows a player to play a tower tile 38 without thereby completing his turn is hereinafter known as "forting".

Figure 12:
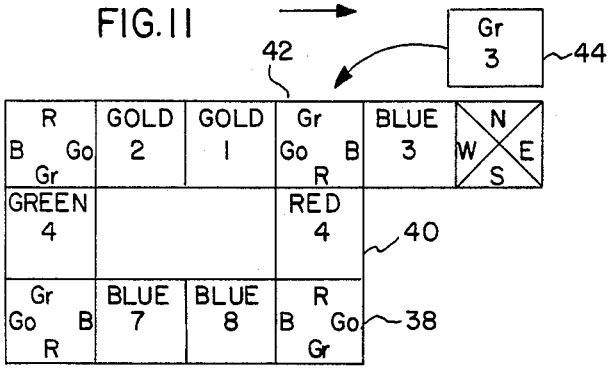
FIG. 12 shows a possible turn after a forting turn.

The next addition to the wall 44 by a player after a forting turn has been played by his opponent, must be an addition to the tower tile 42 in the existing wall (FIG. 12).

There are two other types of sub-categories of tile, the wind tiles 16 (FIG. 4), and the soldier tiles 18 (FIG. 5), which the player will have to play if the player is to add the maximum number of tiles possible to the wall.

The wind tiles 16 have a special function as they are the most difficult tiles to add to the wall, therefore they play a key part in the game. They can be added only to cross over an existing part of the wall 50 which lies across the line of a player's intended construction of the wall 46 (FIG. 13).

Figure 14:
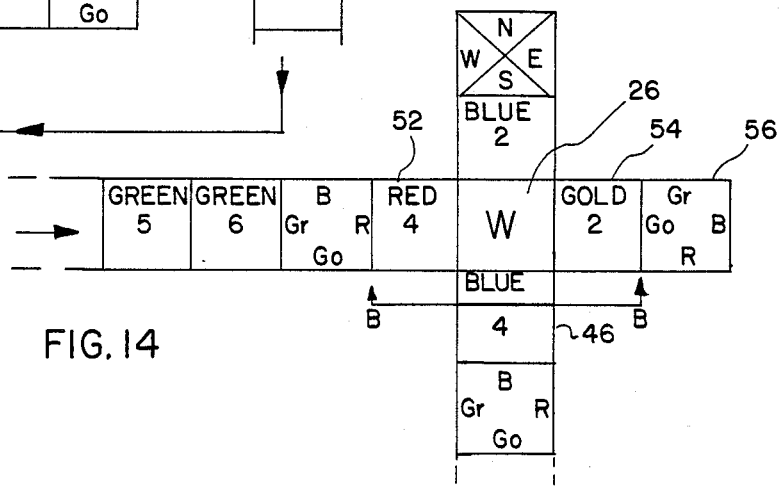
FIG. 14 shows a top plan view of a wind tile ("winding") turn whereby the wall is crossed.

A wind tile 26 is played by laying it on top of the tile 50 belonging to the existing wall that is blocking the further construction of the wall in the direction in which the immediately previously played tile 52 was played (FIG. 14).

Figure 13:
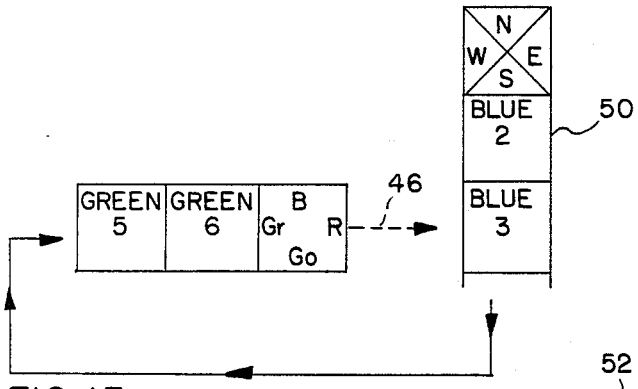
FIG. 13 shows a situation where the wall must be crossed if the next player wishes to play a red wall tile.

FIG. 13 shows the BLUE 3 50 tile blocking a potential path of construction 46. A wind tile can be played only from the direction of the wind enscribed upon it, that is either from North, South, East or West, and can be used only in the direction of the wall or tower tile to which it is added 52. The directions of North, South, East and West in a game is dictated by the indicia of the start tile 10.

Figure 15:
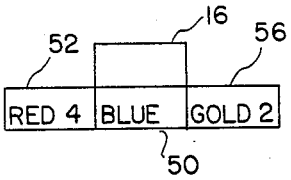
FIG. 15 is a side elevational view taken from B—B of FIG. 14.

A wind tile 16 is the only tile which can be laid on top of the wall. Obviously, the wind tile 16 cannot always be played in the same manner as a wall or tower tile because often it will be laid at a higher level than the tile to which it is added 52 (FIG. 15). But the side of the tile 50 upon which the wind tile is laid must touch a side of the tile 52 to which the wind tile is added (FIG. 15).

After playing the wind tile 16 on top of the wall, the player may complete the turn by adding a tower tile to the wind tile, that is, by playing a tower immediately over the wall in the direction of movement. In adding a tower tile to a wind tile the player may choose any side of the tower tile to be placed adjacent to the wind tile.

However, instead of adding a tower tile to the wind tile, the player may extend his turn by adding one or more (if a pile or straight) wall tiles 54 to the wind tile in the direction of movement and then playing his tower tile 56 in the usual manner, described above, for completing a turn (FIG. 14). This additional wall tile (or pile or run of tiles) may be of a different color from the tile 52 to which the wind tile was added. In other words, after a wind tile a player may continue a turn with a tile (or run or pile) of any color as long as it continues the direction of movement.

In crossing the wall, the wind tile 48 may be played on any type of tile (wall tile 12, tower tile 14, soldier tile 18) except the start tile 10.

Only wind tiles may be played on top of the wall. It is to be noted that this does not preclude the playing of "piles" as hereinbefore described.

Figure 16:
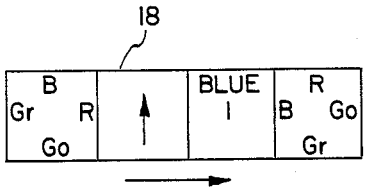
FIG. 16 shows a turn substituting a soldier tile for a wall tile adjacent a tower tile.
Figure 17:
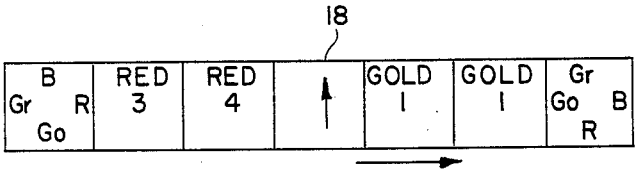
FIG. 17 shows a turn substituting a soldier tile for a wall tile adjacent a wall tile.

A soldier tile has the special function of being able to perform the role of either a wall tile 12 or a tower tile 14 (but not a wind tile 16) and in either role has the great advantage of being able to be added to any other tile and to have any other tile added to it (FIGS. 16 and 17). The two exceptions to this rule are that when played to perform the role of a tower tile, a soldier tile can not be added to a tower tile or have a tower tile added to it and that the playing of a soldier tile as a wall or tower tile cannot override the rules relating to the playing of wind tiles.

Figure 18:
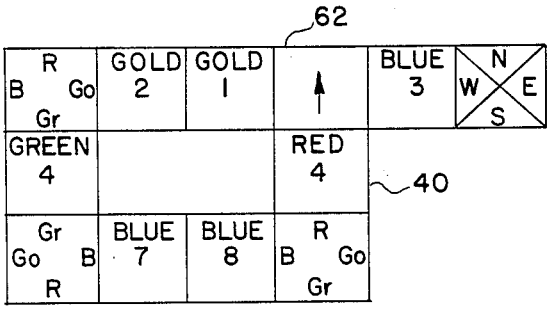
FIG. 18 shows a forting turn wherein a soldier tile has been previously played as a tower tile.

In forting a player may play one or more of the soldier tiles to perform the role of wall tiles or the tower tile and the tower in the existing wall to which the second addition of wall tile(s) is connnected may be a soldier tile that has been played to perform the role of a tower tile 62 (FIG. 18).

Figure 19A:
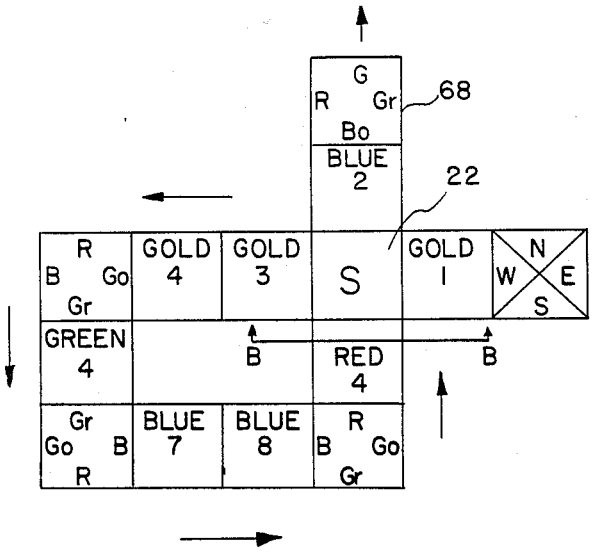
FIG. 19*a* shows the turn of wind forting wherein the wall is crossed during a forting turn by playing a wind tile.
Figure 19B:
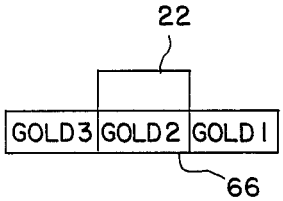
FIG. 19*b* is an elevational view of the wind forting turn taken from B—B of FIG. 19*a;*

However, the playing of a wind tile in a forting turn is more complicated and is known hereinafter as "wind forting". The second part of a wind forting turn differs from an ordinary forting turn in that instead of connecting with a tower tile in the existing wall (FIG. 11), a wind tile 22 is played in the usual manner to allow this second addition to cross over the existing wall (FIGS. 19*a* and 19*b*). In wind forting, the wind tile 22 can be laid on top of any type of tile 66, and the turn must then be continued in the usual manner applying to the playing of wind tiles. Thus a second tower 68 must be played, either immediately or following the playing of further wall tile(s), to complete the turn and so wind forting is the only occasion when a player can and indeed must play two towers (or one or two soldier tiles performing the role of a tower tile) in one turn (FIG. 19*a*).

When playing the last remaining tile of the "open hand" the player completes the turn by playing a tower tile in the manner described and thereafter replenishes the hand with the tiles of the "concealed" hand. The now exposed (to the player, not his opponent) "concealed" hand is to be used in the next and future turns of the player.

The players must add to the wall when they possibly can, but if they are unable to add to the wall when it is their turn to do so, they must pass up their turn to play and it is up to the player whose turn is next to attempt to add to the wall.

If no player in the game can add to the wall, then the winner is the player who has added the most tiles from his hand to the wall during the game. However, for the purpose of determining the winner of the game, tower tiles are not to be included in calculating the total of tiles a player has added to the wall. The winner can be determined by calculating the number of tiles, excluding tower tiles, remaining in the hands of each player at the end of the game, for the player with the fewest tiles remaining must be the winner. If the players have the same fewest number of tile remaining the player with the fewer winds left unplayed is the winner as the winds are the most difficult tiles to dispose of. If also the number of wind tiles remaining is equal the game is drawn.

However, if any player is able, during his turn, to dispose of all of the tiles remaining in his hand (excluding tower tiles but including both "open" and "concealed" hands and winds and soldiers), the game is ended and the said player is the winner.

Each game as described represents one season's construction and a rubber is played by continuing four seasons to represent a full year. Players take turns to have the North wind and therefore the first turn.

The winner of the rubber is the player with the most wins in the four seasons. If the result is, for instance with two players only, 2 wins each or 1 win each and 2 draws (or even 4 draws), the winner is determined by totalling the number of tiles left unplayed (excluding towers) after each season, the player with the smaller total being the winner.

If the result is still a tie, the winner is the player with the smaller total of wind tiles unplayed. It is therefore necessary to record the number of each player's tiles remaining at the end of each season's construction, (noting also the number of wind tiles) but this total will be required only if no players finish with more wins than the other player or players.

The detailed description of the game that has been given hereinbefore has envisaged the use of square shaped tiles. However, the game can be played with tiles of other shapes and preferably of rectangular shape. If the rectangular shaped tiles are used it is preferable that the following modifications be made to the game.

Firstly, the tower tiles are to be of two different types with each type having an equal number of identical members with the members of one type having the four suit colors distributed in the same relation to one another as on the other type of tower tile, but having the color that are allocated to the longer edges of this other type of tower tile allocated to the shorter edges of this other type of tower tile allocated to the longer edges (FIGS. 20*a* to 20*e* and FIGS. 21*a* to 21*e* show these two types of tower tile) and at the setting up of each game each player selects an equal number (preferably four) of members of each of the two types of tower tile.

Figure 22A:
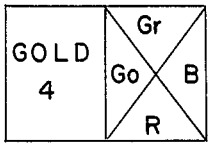
FIG. 22*a* is a top plan view of a rectangular tower tile correctly added to a rectangular wall tile.
Figure 22B:
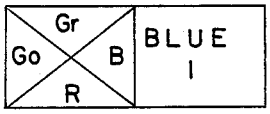
FIG. 22*b* is a top plan view of a rectangular tower tile.
Figure 23A:
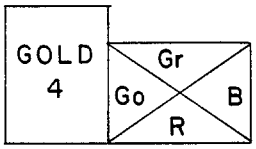
FIG. 23*a* is a top plan view of a rectangular tower tile added to a rectangular wall tile in a way that is not permissible.
Figure 23B:
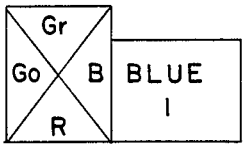
FIG. 23*b* is a top plan view of a rectangular wall tile added to a rectangular tower tile in a way that is not permissible.
Figure 24A:
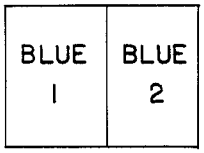
FIGS. 24*a* and 24*b* are top plan views of rectangular wall tiles correctly added together to form a straight or run.
Figure 24B:
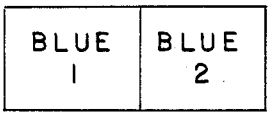

Secondly, when matching a tower tile and a wall tile for purposes of adding one of these tiles to the other, the player must fulfill not only all the requirements listed hereinbefore for adding such tiles to each other but also the extra requirement of matching the length of the edges that are to touch each other when one tile is added to the other so that either one of the longer edges of the wall tile (FIG. 22*a*) of one of the shorter edges of the tower tile is to touch one of the shorter edges of the wall tile (FIG. 22*b*) but a shorter edge of the tower tile is not to touch a longer edge of the wall tile (FIG. 23*a*) and a longer edge of the tower tile is not to touch a shorter edge of the wall tile (FIG. 23*b*). This extra requirement to match the length of edges when adding one tile to another also applies to wall tiles added together in a run or straight (FIGS. 24*a* and 24*b*) show correct addition, and FIGS. 25*a* and 25*b* incorrect addition, of the wall tiles to form a run) and also applies to adding soldier tiles or wind tiles to other tiles.

I claim:

1. Apparatus for a game for a number of players comprising:

a set of tiles having a shape suitable to enable said tiles to be stably placed on a substantially flat playing support surface and to enable at least one of said tiles to be stably placed on top of another of said tiles;

discrete edges on said tiles suitable to enable a player to place one edge of one of said tiles against one edge of another of said tiles thereby establishing a directional relationship between said tiles;

said set of tiles being separated into a plurality of sub-categories of tiles; and means on the tiles of each of said sub-categories for identifying tiles as a member solely of a respective sub-category;

one of said sub-categories comprising tower tiles required to complete each turn and having a plurality of separate indicia assigning suits to their edges;

another of said sub-categories comprising unique wall tiles having indicia thereon of a plurality of suits, the suits being the same as those indicated on said tower tiles, and each suit having the indicia of a sequence;

so that players taking turns construct a common wall from said tiles by adding tiles edge to edge playing a single wall tile and optionally playing several wall tiles of the same suit in sequential order with the adjacent edges of said tiles being equal in length and said tiles forming a straight line run of tiles and optionally playing wall tiles of differing suits one upon another in the same position having the same indicia of a sequence thereby forming a pile, and optionally playing a run containing at least one pile, and playing a tower tile to complete a turn and provide a location from which to start the next turn and allow a change of direction providing that the suit and length of the tower tile edges adjacent to the wall tiles after and before which said tower tile is played match the suit of said wall tiles and the length of their adjacent edges, the player playing all the tiles in his hand (excluding leftover tower tiles) before all opposing players being the winner, and in the event that no player is able to play all the tiles in his hand (excluding leftover tower tiles) the winner is determined by reference to the number of tiles remaining in each player's hand, and further comprising a further subcategory of tiles comprising unique wind tiles having directional indicia thereon which are required to cross over the wall in a direction indicated by said indicia, the playing of a wind tile to cross the wall being achieved by placing any said wind tile in the constructed wall.

2. Apparatus as claimed in claim 1 wherein there is further provided a further subcategory of tiles comprising at least one soldier tiles playable as a substitute for any other subcategory of tile with the exception of wind tiles, the playing of a soldier tile in place of any wall or tower tile being permitted.

3. Apparatus for a game as claimed in claim 2 wherein said at least one soldier tile comprises four members.

4. Apparatus for a game as claimed in claim 1 wherein said wind tiles comprise four members.

5. Apparatus for a game for a number of players comprising:

a set of tiles having a shape suitable to enable said tiles to be stably placed on a substantially flat playing surface and to enable at least one of said tiles to be stably placed on top of another of said tiles;

discrete edges on said tiles suitable to enable a player to place one edge of one of said tiles against one edge of another of said tiles, thereby establishing a directional relationship between said tiles;

said set of tiles being separated into a plurality of sub-categories of tiles; and means on the tiles of each of said sub-categories for identifying tiles as a member solely of a respective sub-category;

one of said sub-categories comprising 16 tower tiles, said tower tiles being required to complete each turn and having a plurality of separate indicia assigning suits to their edges;

another of said sub-categories comprising unique wall tiles having indicia thereon of a plurality of suits, the suits being the same as those indicated on said tower tiles, and each suit having the indicia of a sequence;

so that players taking turns construct a common wall from said tiles by adding tiles edge to edge playing a single wall tile and optionally playing several wall tiles of the same suit in sequential order with the adjacent edges of said tiles being equal in length and said tiles forming a straight line run of tiles and optionally playing wall tiles of differing suits one upon another in the same position having the same indicia of a sequence thereby forming a pile, and optionally playing a run containing at least one pile, and playing a tower tile to complete a turn and provide a location from which to start the next turn and allow a change of direction providing that the suit and length of the tower tile edges adjacent to the wall tiles after and before which said tower tile is played match the suit of said wall tiles and the length of their adjacent edges, the player playing all the tiles in his hand (excluding leftover tower tiles) before all opposing players being the winner, and in the event that no player is able to play all the tiles in his hand (excluding leftover tower tiles) the winner is determined by reference to the number of tiles remaining in each player's hand.

6. Apparatus for a game for a number of players comprising:

a set of rectangular tiles having a shape suitable to enable said tiles to be stably placed on a substantially flat playing support surface and to enable at least one of said tiles to be stably placed on top of another of said tiles;

discrete edges on said tiles suitable to enable a player to place one edge of one of said tiles against one edge of another of said tiles thereby establishing a directional relationship between said tiles;

said set of tiles being separated into a plurality of sub-categories of tiles; and means on the tiles of each of said sub-categories for identifying tiles as a member solely of a respective sub-category;

one of said sub-categories comprising tower tiles required to complete each turn and having a plurality of separate indicia assigning suits to their edges;

another of said sub-categories comprising unique wall tiles having indicia thereon of a plurality of suits, the suits being the same as those indicated on said tower tiles, and each suit having the indicia of a sequence;

so that players taking turns construct a common wall from said tiles by adding tiles edge to edge playing a single wall tile and optionally playing several wall tiles of the same suit in sequential order with the adjacent edges of said tiles being equal in length and said tiles forming a straight line run of tiles and optionally playing wall tiles of differing suits one upon another in the same position having the same indicia of a sequence thereby forming a pile, and optionally playing a run containing at least one pile, and playing a tower tile to complete a turn and provide a location from which to start the next turn and allow a change of direction providing that the suit and length of the tower tile edges adjacent to the wall tiles after and before which said tower tile is played match the suit of said wall tiles and the length of their adjacent edges, the player playing all the tiles in his hand (excluding leftover tower tiles) before all opposing players being the winner, and in the event that no player is able to play all the tiles in his hand (excluding leftover tower tiles) the winner is determined by reference to the number of tiles remaining in each player's hand;

said tower tiles comprising two types, and edges of equal length and the same suit must be matched when adding a tower tile.

7. A process for playing a game by a plurality of players comprising:

providing a set of tiles having a shape suitable to enable said tiles to be stably placed on a substantially flat playing support surface and to enable at least one of said tiles to be stably placed on top of another of said tiles, the edges of said tiles being suitable to enable the player to place one edge of one of said tiles against one edge of another of said tiles thereby establishing a directional relationship between said tiles;

separating said set of tiles into a plurality of sub-categories of tiles, each of said sub-categories comprising tiles which are indentifiable as a member of a given sub-category, the game requiring the players to construct a common continuous wall using said tiles;

each player randomly each player randomly selecting a pre-determined number of tiles from one of said sub-categories comprising tower tiles required to complete each turn and having indicia assigning suits to their edges;

selecting a predetermined number of tiles from another of said sub-categories comprising unique wall tiles of a number of suits, the suits being the same as those indicated on the tower tiles and each suit having a number sequence;

said players taking turns to play tiles for constructing said wall from said tiles by adding tiles to one end of the wall;

each turn comprising, playing a single or several wall tiles one adjacent a tile having the same suit in a sequential manner with the adjacent edges of said tiles being equal in length and the said tiles forming a straight line of tiles forming a straight or playing said wall tiles one upon another of differing suits and of the same position in the sequence of their suits forming a pile or playing a straight containing one or more piles, and playing a tower tile to complete a turn and provide the location from which to start the next turn and allow a change of direction providing that the suit and length of the tower tile edges adjacent to the wall tiles after and before said tower tile is played match the suit of said wall tiles and the length of their adjacent edges, each player to win playing all the tiles in his hand (excluding leftover tower tiles) before the opposing player or players and in the evnet that no player is able to play all the tiles in his hand (excluding leftover tower tiles) the winner is determined by reference to the number of tiles remaining in each player's hand.

8. The process as claimed in claim 7 wherein prior to playing, each player randomly selects a predetermined number of wall tiles, the identity of which is known to him only, to form an open hand and an additional number of wall tiles, the identity of which is unknown to all players and unknown to the particular player who selected said tiles for a part of the game to form a concealed hand, and during playing each player first plays said tiles from said open hand and thereafter when the entire open hand has been played, the tiles from said concealed hand.

9. The process as claimed in claim 8 and further comprising:

providing thirty-two wall tiles; and providing sixteen tower tiles.

10. The process as claimed in claim 7 and further comprising:

providing a further subcategory of unique wind tiles having directional indicia thereon which are required to cross over the wall in a direction indicated by said indicia; and playing a wind tile to cross the wall by placing any said wind tile in the constructed wall.

11. The process as claimed in claim 10 and further comprising:

providing a further subcategory of tile of at least one soldier tile playable as a substitute for any other subcategory of tile with the exception of wind tiles; and playing a soldier tile in place of any wall or tower tile.

12. The process as claimed in claim 11 and further comprising:

providing four wind tiles; and providing four soldier tiles.

13. The process as claimed in claim 7 and further comprising:

providing a start tile; and defining a location from which the first turn is to be taken in a predetermined direction by positioning said start tile on said playing surface.

14. The process as claimed in claim 7 wherein:

said tiles are rectangular;

two types of tower tiles are provided; and modifying the rules to require edges of equal length to be matched and suits to be matched when adding a tower tile.

* * * * *